United States Patent [19]

Draper et al.

[11] Patent Number: 4,749,023

[45] Date of Patent: Jun. 7, 1988

[54] COOLING SYSTEM FOR CONTINUOUS METAL CASTING MACHINES

[75] Inventors: Robert Draper, Churchill Boro; Wayne C. Sumpman, North Huntingdon; Robert J. Baker, Wilkins Township, Allegheny County; Robert S. Williams, Plum Borough all of Pa.

[73] Assignee: Westinghouse Electric Corp., Pittsburgh, Pa.

[21] Appl. No.: 857,674

[22] Filed: Apr. 30, 1986

[51] Int. Cl.[4] ..... B22D 11/06; B22D 11/22

[52] U.S. Cl. ..... 164/429; 164/443; 164/485; 165/89

[58] Field of Search ..... 164/485, 443, 428, 348, 164/479, 429, 442, 448; 165/89

[56] References Cited

U.S. PATENT DOCUMENTS

| | | | |
|---|---|---|---|
| 1,651,502 | 12/1927 | Banbury | 165/89 |
| 1,892,028 | 12/1932 | Alderfer | 165/89 |
| 2,671,278 | 3/1954 | Hinnekens | 165/89 |
| 2,793,006 | 5/1957 | Eaby | 165/89 |
| 3,419,068 | 12/1968 | Grierson | 165/89 |
| 4,307,771 | 12/1981 | Draizen et al. | 164/485 |
| 4,489,772 | 12/1984 | McLane et al. | 164/485 |
| 4,502,528 | 3/1985 | Frissora et al. | 164/485 |
| 4,537,239 | 8/1985 | Budzyn et al. | 164/443 |

*Primary Examiner*—Nicholas P. Godici
*Assistant Examiner*—Samuel M. Heinrich
*Attorney, Agent, or Firm*—B. R. Studebaker

[57] ABSTRACT

A continuous metal caster cooling system is provided in which water is supplied in jets from a large number of small nozzles 19 against the inner surface of rim 13 at a temperature and with sufficient pressure that the velocity of the jets is sufficiently high that the mode of heat transfer is substantially by forced convection, the liquid being returned from the cooling chambers 30 through return pipes 25 distributed interstitially among the nozzles.

14 Claims, 4 Drawing Sheets

COOLING SYSTEM FOR CONTINUOUS METAL CASTING MACHINES

GOVERNMENTAL CONTRACT

The Government has rights in this invention pursuant to Contract No. DE-AC07-38ID12443 awarded by the U.S. Department of Energy.

BACKGROUND OF THE INVENTION

This invention pertains to a cooling system for a thin section continuous casting machine of advanced design which will provide the initial forming stage in a process route which leads to cold rolled strip and sheet steel.

In a thin section continuous caster operating at a relatively high casting speed, the moving surface which receives the molten steel is subjected to an extremely high heat flux. For purposes of example, one given prototype caster which may have 0.05 inch (0.13 cm) thick steel cast at a speed of 25 ft./sec. (7.6 m/sec.) on a drum which is about 7 ft. (2.13 m) in diameter, and with a desired puddle length of 3 ft. (0.91 m), the average heat flux over the solidification zone on the outside surface of the caster drum is $6.2\times10^6$ BTU/ft.$^2$-hour (1.98 kW/cm$^2$). A comparable heat flux is experienced in the zone where the sheet is sub-cooled below the solidification temperature prior to leaving the caster drum. By way of reference, this heat flux is about an order of magnitude higher than the maximum heat flux existing in the core of a pressurized water-cooled nuclear reactor, and is comparable with heat fluxes experienced at the surfaces of chemical rocket nozzles. Accordingly, a cooling system using extraordinary cooling methods must be employed in order to prevent deformation of the caster drum.

It is the aim of this invention to provide such a cooling system which is adequate to accommodate the heat flux for a caster such as the prototype to be described herein, as well as other parametrically similar casters.

SUMMARY OF THE INVENTION

In accordance with the invention, important features include the provision of fluid flow outlet means, preferably in the form of small diameter nozzles which direct liquid coolant against the inner surface of the rim of the rotating caster drum in the form of high velocity jets, and of a lesser number of return pipes of a diameter larger than the nozzles distributed interstitially between the nozzles to receive the return coolant. A liquid flow system is provided which includes pumping means connected to supply liquid to the nozzles at a temperature and with sufficient pressure that the velocity of the jets out of the nozzles is sufficiently high that heat transfer at the caster drum rim inner face is substantially by forced convection as distinguished from nucleate and film boiling. It is also noted that the system is distinctly different from one in which the cooling might be characterized as spray cooling. Details of how a system according to the invention is obtained will be described hereinafter.

DETAILED DESCRIPTION OF THE INVENTION

The invention will be described principally in connection with a prototype caster of the rotating drum type adapted to produce low carbon steel strip or sheet of 0.05 inches (0.13 cm) in thickness, with the linear casting speed being 25 ft./sec. (7.6 m/sec.). The prototype caster substrate on which the material is poured is Berylco 14 (trademark of Cabot Berylco, Division of Cabot Corporation, Reading, Pa. 19603), and the drum diameter is approximately 7 ft. (2.13 m). The substrate could be of other metals or alloys such as regular copper or a stainless steel, for example.

Figure 1:
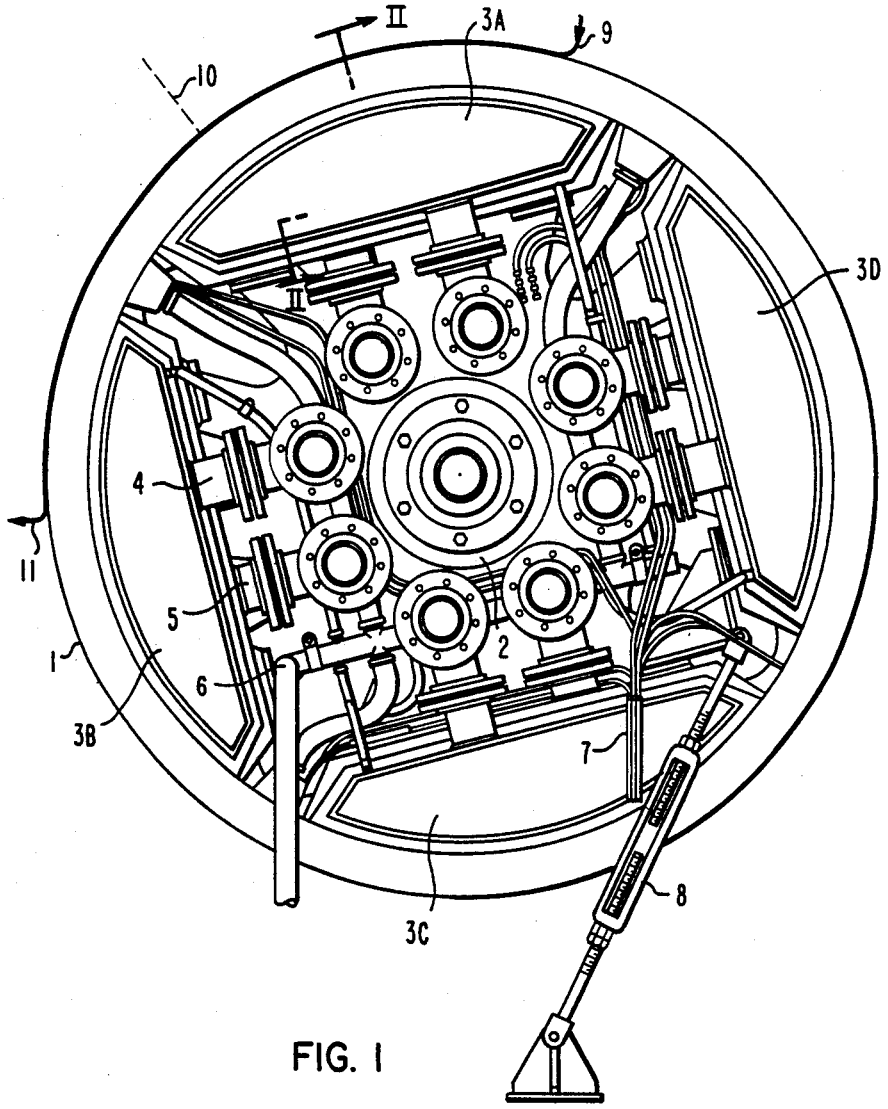
FIG. 1 is an elevational view of the assembly of a caster drum with the cooling system of the invention.

Referring to FIG. 1, the overall assembly of the caster and cooling system includes the caster drum generally designated 1, a hub 2 which partly supports the shaft of the caster drum, a number of modular coolant assemblies, (in this case four denoted 3A, B, C and D), a coolant feed pipe 4 for each assembly, a coolant discharge pipe 5 for each assembly, a scavenger pipe 6, seal inflation tubes 7, and a seal drum positioning strut 8.

The molten metal is poured onto the outer surface of the rim of the rotating drum at a point such as indicated at 9, is solidified in being on the rim surface through a first arc over to about the location 10 and is cooled on the rim surface through a second arc over to the location 11, at which point it is removed from the rim surface.

Figure 2:
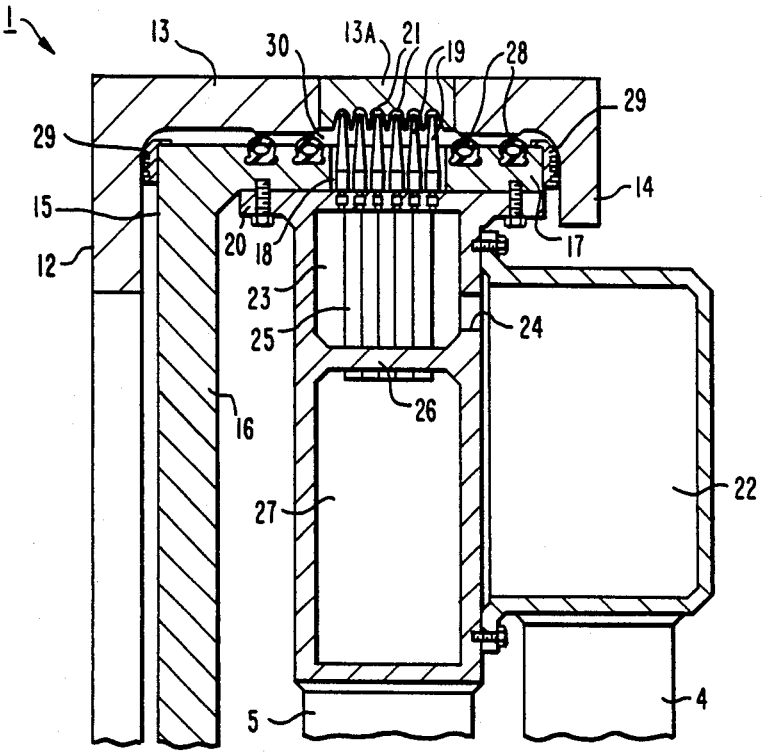
FIG. 2 is a partly schematic cross-sectional view corresponding to one taken along the line II—II of FIG. 1.
Figure 3:
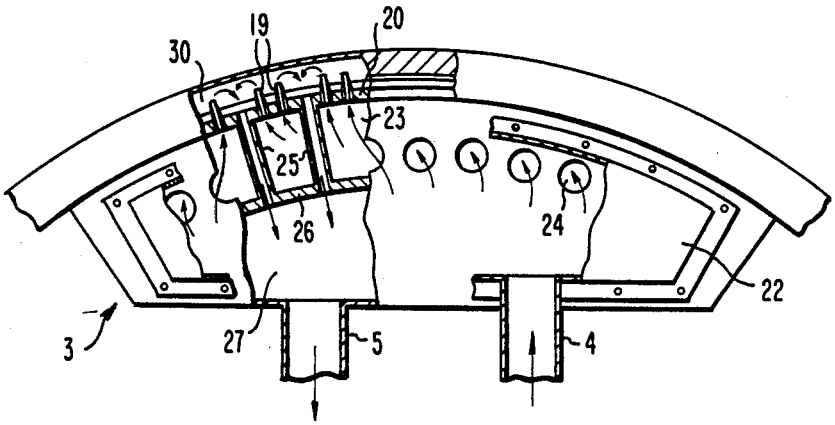
FIG. 3 is a partly broken, somewhat schematic elevational view illustrating the basic flow system in a single modular coolant assembly.

Referring to FIGS. 2 and 3, the caster drum generally designated 1 includes a backplate 12, a peripheral rim 13 including an intermediate portion 13A upon which the strip steel is to be laid and which is of a copper alloy material, and with the rim having a radially inwardly extending flange 14 at its axial side opposite the backplate.

A seal drum generally designated 15 includes a disc-shaped backplate 16 and a peripheral rim 17 and is stationarily and concentrically disposed within the rotatable caster drum.

The peripheral rim 17 of the seal drum is provided with slot means in the form of a single aperture 18 (FIG. 4) associated with each modular cooling assembly 3. In the prototype example, each aperture subtends 80° of arc and each aperture is separated by 10° from each next adjacent aperture associated with another coolant assembly. These apertures accommodate the groups of nozzles 19 (FIG. 2) associated with each modular coolant assembly, the nozzles being supported by an outer plate 20 of the assembly and being secured to the peripheral rim 17 of the seal drum, with the nozzles 19 protruding through the aperture 18.

In the prototype example, each modular coolant assembly is provided with 384 nozzles in six axially spaced-apart rows of 64 circumferentially spaced-apart nozzles. In the prototype example, the nozzles are of 0.125 inch (0.32 cm) diameter placed on a 0.5 inch (1.27 cm) transverse pitch by 0.75 inch (1.90 cm) longitudinal pitch to form a rectangular pattern. The quotient of initial jet area divided by projected area cooled per nozzle is 1/30. Each group of nozzles subtends 75° to fit circumferentially within the apertures 18, with the width of each aperture being slightly greater than that of the nozzle group which protrudes through the aperture.

The part 13A (FIG. 2) of the caster drum peripheral rim upon which the molten metal is received is provided with a series of circumferential grooves 21 into which the circumferentially extending rows of nozzles are received with the nozzle tips being closely adjacent the base of the grooves, such as about 0.25 inch (0.63 cm) in the prototype example. By virtue of these grooves in the inside surface of the caster drum, the heat transfer area is extended.

Other parts of each modular coolant assembly include a side chamber 22 (FIG. 2) to which liquid coolant is supplied through the feed pipe 4, a feed chamber 23 into which the coolant is supplied through openings 24, the feed chamber being in communication with the base of the nozzles which are received by the outer plate 20.

Radially oriented coolant return tubes 25 (FIG. 2) have their radially outer open ends carried by the outer plate 20 and their radially open inner ends carried by an inner plate 26 which separates the feed chamber 23 from the discharge chamber 27, the discharge chamber 27 in turn being connected to the discharge pipe 5. The prototype example has one return tube for each set of four nozzles with the return tube cross sectional area approximately equalling that of four nozzles.

In the currently preferred form of the invention, inflatable static seals 28 (FIG. 2) are provided in grooves in the periphery of the seal drum rim 17 and dynamic seals indicated at 29 are provided between the opposite axial edges of the seal drum rim and the facing parts of the caster drum which, on one side is the backplate 12 of the caster drum and on the other side is tha flange 14 of the drum. When the caster drum is rotating relative to the seal drum, the seals 28 are deflated and the dynamic seals 29 perform the sealing function. Details of the arrangement of the dynamic seals will be treated later herein. The static seals 28 have been found useful in their inflated form when the caster drum is not rotating relative to the seal drum. In operation, when the caster drum rotates relative to the seal drum and metal strip is being formed, the boundaries of the cooling chamber 30 are the dynamic seals 29 upon the axially opposite side of the seal drum, the inner face of the peripheral rim 13 of the caster drum, and the radially outer face of the rim 17 of the seal drum and the radially outer face of the outer plate 20 carrying the nozzles 19.

The flow of the liquid coolant in a schematic way through a single modular coolant assembly is perhaps best understood in connection with FIG. 2 in which the arrows indicate the passage of the liquid. The flow is from feed pipe 4 into chamber 22, through openings 24 into feed chamber 23 through the nozzles 19 into the cooling chamber 30, with the coolant returning through pipes 25 into the discharge chamber 27 and then through discharge pipe 5.

As can be seen from FIG. 1, the modular coolant assemblies carried by the seal drum are disposed in adjacent end-to-end relation, with each extending over some arcual distance. In the preferred example each assembly subtends an arc of about 90° so that the four modular assemblies fully circumscribe the interior of the caster drum. In the prototype example, the modular coolant assemblies 3A–D are structurally substantially identical, which promotes simplicity in manufacture. With a complete circle being formed by the modular assemblies, the cooling chambers 30 associated with all the assemblies are hydraulically connected by virtue of the continuous space formed between the caster drum, the seal drum and the dynamic seals. There may be instances where the modular assemblies have an arc subtending an angle other than 90°, such as 120°. Also, it is contemplated that the assemblies could cover something less than a full circle, but it is believed that at least a major part of the circle should be covered.

A continuous casting machine utilizing a rotating drum has three distinct cooling regions. These are the melt solidification region located between points 9 and 10 in FIG. 1, the solid cooling region (over which the section is cooled below the solidification temperature before being stripped off the drum at 11), and the drum cooling region (over which the drum is brought back to a lowered temperature before it again encounters the molten steel), this region being between points 11 and 9 in FIG. 1.

Most efficient use of a given coolant flow rate is achieved if the water jet velocities in each of the three cooling regions is controlled separately. For this reason, the cooling nozzles are divided into groups which, broadly speaking, serve each of the three regions. The first group of nozzles provided by assembly 3A (FIG. 1) extends through an arc from just before the pour point to just beyond the point 10 where complete solidification of the strip is expected. The second group of nozzles provided by assembly 3B extends through an arc which covers the remainder of the solid cooling region to point 11 and extends somewhat into the drum cooling region. The third group of nozzles associated with assemblies 3C and 3D is entirely devoted to drum cooling and extend through the remainder of the arc of the circle.

Figure 5:
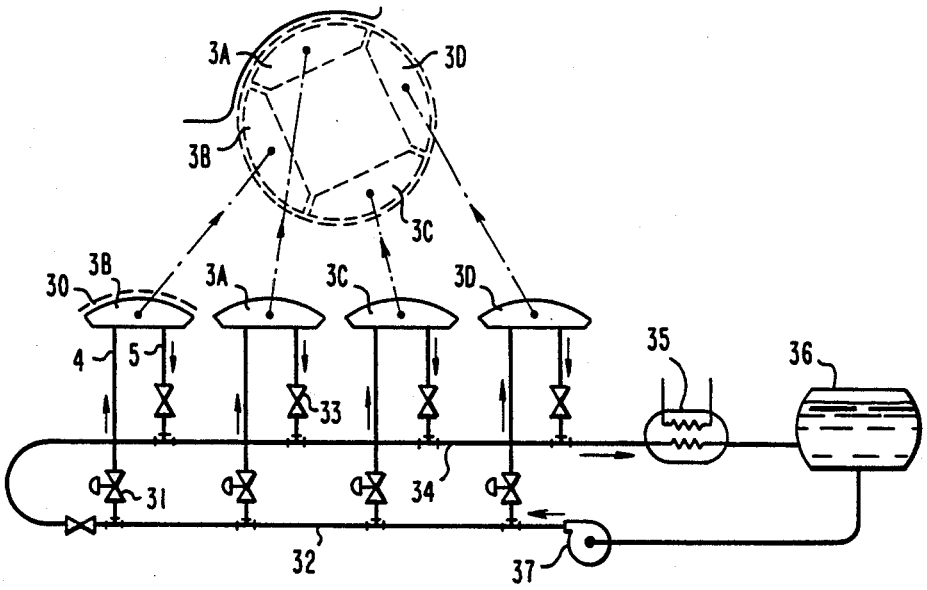
FIG. 5 is a schematic view of the liquid cooling circuit in accordance with the invention.

A liquid flow system for use in the invention is schematically illustrated in FIG. 5. While a wide range of candidate fluids was considered, water is the clear choice among those examined. The water would be treated with a corrosion inhibitor and might carry an anti-freeze additive if the plant were located in a northern region and long periods of inactivity were anticipated. In FIG. 5, the modular coolant assemblies 3A–D at various locations relative to the drum are separately shown in their connected relation to the cooling circuit. A flow control valve 31 is placed in the feed line 4 which connects each coolant assembly to the feed header 32. A back pressure regulating valve 33 is placed in each of the four discharge lines 5 which connect the coolant assemblies to the discharge header 34. By this means, the cooling jet velocity can be independently regulated in each cooling region. The circuit also includes a cooling heat exchanger 35, a reservoir 36, and a circulating pump 37.

Independent regulation of the average pressure in the four interconnected cooling chambers 30 associated with each cooling region controls the flow of coolant from region to region. For example, it is possible by opening the back pressure regulating valve 33 in the discharge line 5 associated with the assembly 3A of the melt solidification region to lower the water pressure in the cooling chamber 30 of this region. This would promote inflow of water from the adjacently connected cooling chambers 30 of the solid cooling (3B) and the drum cooling (3D) regions and thus would prevent the formation of relatively stagnant regions between the nozzle groups.

Figure 7:
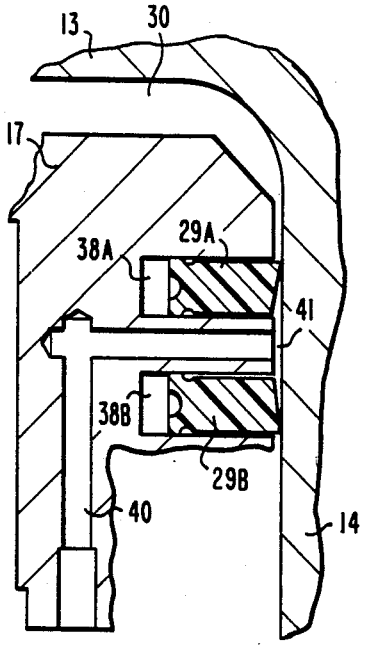
FIG. 7 is a fragmentary view of a water supply arrangement for the dynamic seal arrangement of FIG. 6.
Figure 6:
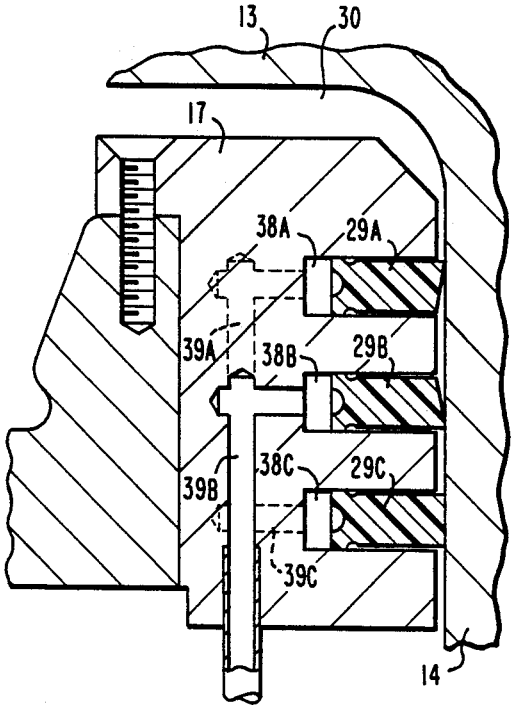
FIG. 6 is a fragmentary, sectional view of one type of dynamic seal arrangement in accordance with the invention.
Figure 8:
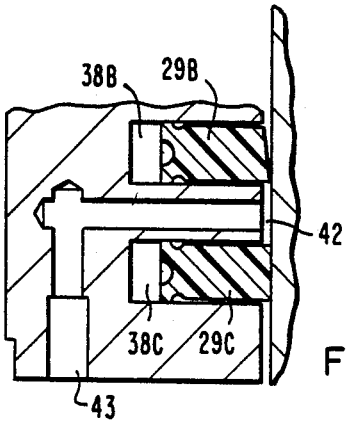
FIG. 8 is a fragmentary view of a water drainage arrangement for the seal of FIG. 6.

The currently preferred dynamic seal arrangement is shown in FIGS. 6–8. Only the dynamic seal arrangement between the edge of the seal drum rim 17 and the caster drum flange 14 is shown in these Figures, it being understood that a similar reversed arrangement is provided at the opposite edge of the seal drum rim and the backplate of the caster drum. Three annular grooves 38A, 38B and 38C are provided on the edge of the rim 17. Each of these receives a sealing ring 29A, 29B, 29C. Each groove is pressurized from separately controlled sources through the lines 39A, 39B and 39C. The ring seals 29A–C may be made of a material such as glass and molydisulfide-filled Teflon, or graphite filled Teflon.

Referring to FIG. 7, it is considered advantageous to provide a supply of clean water through the conduit 40 to the annular cavity 41 defined between the radially outer seal ring 29A and the intermediate seal ring 29B with most of this water escaping to the cooling chamber 30.

To the extent that water from the cavity 41 escapes to the cavity 42 (FIG. 8) defined between the ring 29B and 29C, this water is drained through conduit 43 to a disposal location. As the water flows from cavity 41 to cavity 42, past seal ring 29B, it experiences a negative pressure drop. Thus the water within cavity 42 is only nominally above ambient pressure. Accordingly, seal ring 29C, which does not pass water and operates in a dry condition, needs only have modest interfacial pressure to ensure adequate sealing and thus will have acceptable wear despite the lack of water lubrication.

Figure 4:
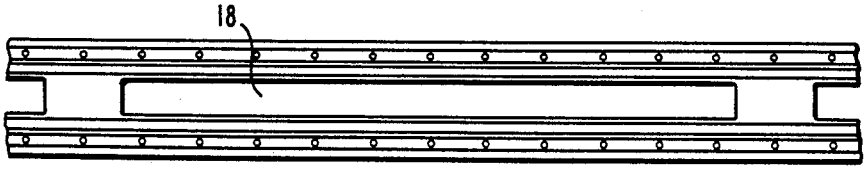
FIG. 4 is a face view of the outer face of a fragmentary portion of the rim of the seal drum.

It will be understood that the sections shown in FIGS. 6–8 are provided at several circumferentially spaced locations along the seal drum rim. For the corresponding dynamic seals between the seal drum backplate and the caster drum backplate, these locations are at the four parts of the seal drum where the lands occur between the apertures 18 (FIG. 4).

It is believed that some of the essential concepts of the invention may be better understood in connection with the following discussion. In operating the cooling system, air or other gas is excluded from the cooling zone. Except for the existence of localized surface boiling in the highest heat flux region, the coolant condition might be characterized as sub-cooled liquid. No bulk boiling exists.

Figure 9:
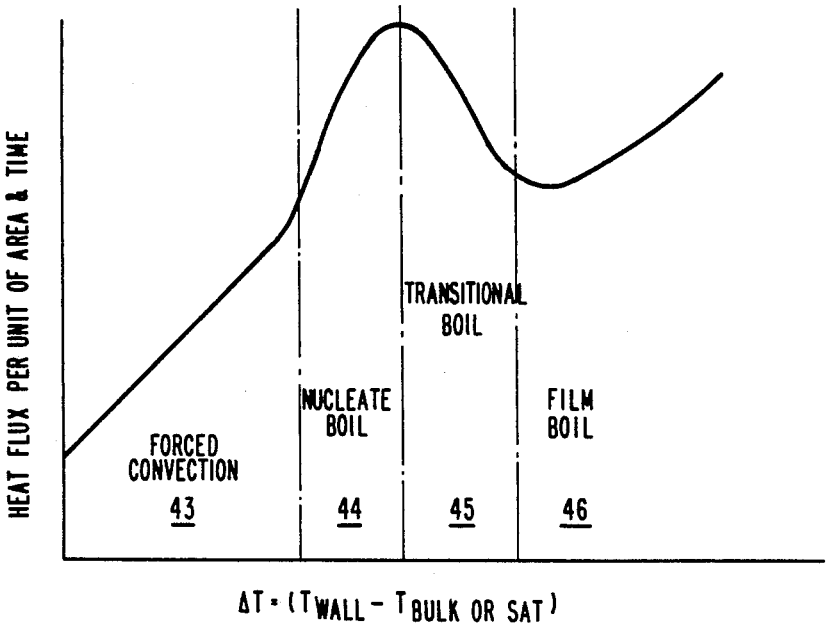
FIG. 9 is a graph illustrating differing modes of heat transfer under different conditions.

In FIG. 9, the ordinate of the graph is the heat flux per unit of area and time while the abscissa is the differential temperature between the wall from which heat is to be transferred and the bulk temperature of the coolant or, with respect to parts of the graph to the right of the forced convection area, the saturation temperature.

Providing a sufficiently high water jet velocity is used in the operation, the mode of heat transfer at the inside surface of the drum from which heat is to be transferred will be intense macro or forced convection augmented to some significantly lesser degree by micro convection associated with sub-cooled surface boiling.

The mechanism which provides the main contribution to the heat transfer process, namely the macro or forced convection associated with the jet streams from the nozzles is driven by the wall to bulk temperature difference. The other mechanism which contributes significantly less to the heat transfer process, namely the micro convection associated with surface boiling or nucleate boiling, is driven by the wall to saturation temperature difference. The liquid supplied to the feed chamber and the nozzles should be at a temperature and have sufficient pressure that the velocity of the jets out of the nozzles is sufficiently high that heat transfer at the caster drum rim inner face is substantially by forced convection, the left area 43 of the graph, as distinguished from nucleate boiling, the area 44 of the graph or transitional or film boiling, the areas 45 and 46 of the graph.

Considerable thought has been given to selecting the jet velocities for the operation of the invention. Using extremely high jet velocities such as those in excess of 250 ft./sec. (76 m/sec.) and a bulk water temperature close to 100° F. (38° C.), the surface can be cooled below the boiling temperature and the mode of heat transfer is all in a liquid-phase forced convection, that is in the area 43 of FIG. 9. It is, however, impractical to operate with such high jet velocities because of the extremely high nozzle pressure drops which are incurred and the enormous amount of water which would have to be pumped. Corrosion could also present a problem. At intermediate jet velocities of between about 25 ft./sec. to 250 ft./sec. (7.6 to 76 m/sec.), the surface from which the heat is to be transferred will exist above the boiling temperature but the bulk water temperature, which has an entering value of about 100° F. (38° C.), will not reach the boiling point. This is the sub-cooled surface boiling mode in which the macroscopic forced convection is slightly augmented by the microscopic convection associated with surface or nucleate boiling. In the sub-cooled surface boiling mode, the heat transfer coefficient is satisfactory and the pressure drop and water flow rates are manageable up to about 100 ft./sec. (30 m/sec.) jet velocity. This is the mode in which the prototype example system is preferred to be operated.

When the jet velocity is reduced sufficiently, such as to less than 25 ft./sec. (7.6 m/sec.) the mode of heat transfer at the surface switches catastrophically through the transistional boiling and to the film boiling mode, areas 45 and 46 in FIG. 9. In this event, the surface becomes blanketed by steam and the drum temperture would rise dramatically. Consequently, provision of a sufficient margin between the operating condition and the transition to film boiling provided the basis for selecting the jet velocity for the prototype example.

From calculations producing an anticipated maximum heat flux in the range of $6.3\times10^6$ BTU/ft.$^2$ hr. to $1.9\times10^6$ BTU/ft.$^2$ hr. (1.98 kW/cm$^2$ to 0.61 kW/cm$^2$) a jet velocity of 60 ft./sec. (18 m/sec.) was selected as being consistent with a transition to film boiling at $9.14\times10^6$ BTU/ft.$^2$ hr. (2.92 kW/cm$^2$) to provide at least a 45% margin on critical heat flux.

It is noted that in the calculations connected with determining the parameters of the prototype example, no credit was taken for the extension to the heat transfer area which arises from the grooving of the inside surface of the caster drum. Naturally, this would have the effect of lowering the actual heat flux to provide a further margin with respect to critical heat flux.

While the description herein has proceeded in connection with a specific prototype example, it is to be understood that a number of the terms are relative rather than absolute. The invention seeks to obtain relatively and reasonably uniform heat transfer effectiveness over the surface to be cooled, and this is more easily obtained with a relatively larger number of smaller nozzles than a smaller number of larger nozzles. One reason for this is that the pattern of heat transfer effectiveness from the nozzle cooling has the general shape of a bell curve with the apex opposite the axis of the nozzle. Thus the closer and more nozzles, the greater the uniformity—all within reason of course as constrained by practical considerations.

It is also conceivable, and within the contemplation of the invention, that the fluid outlet means into the cooling chamber could take the form of a slot nozzle in each row, rather than the discrete small nozzles forming the row. This is not considered preferable currently however since there could be problems with instability of dimensions of the slot along its length. Further, it is important that the flow to the slot be relatively uniform along its length which could give rise to some problems, and, as a practical matter would require that the return pipes be discrete to permit the flow to reach the rows closer to the backplate.

The reason for the nozzle tip being relatively close to the surface to be cooled is that it is desirable that the jet velocity at the cooled surface be as close as reasonably possible to the originating jet velocity, since the velocity is such an important factor in the heat transfer.

We claim:

1. A cooling system for a thin section continuous steel caster of the type including a rotating caster drum having a backplate and a peripheral rim in which molten metal is poured onto the drum peripheral rim exterior surface at a deposition location, is solidified in being on said rim surface through a first arc and is cooled on said rim surface through a second arc before being removed from said rim surface, comprising:

a stationary seal drum including a disc-shaped backplate and a peripheral rim with circumferentially extending slot means therein, concentrically mounted within said caster drum with said caster drum rim and said seal drum rim generally defining the radially outer and inner boundaries of an annular cooling chamber therebetween;

a number of modular coolant assemblies carried by said seal drum in adjacent end-to-end relation, each extending over some arcual distance, with the total number of said coolant assemblies extending through at least the major part of a full circle;

each assembly including fluid flow outlet means projecting through said slot means and directed generally radially outwardly to issue liquid coolant outwardly in jet form into said cooling chamber and against said caster drum rim;

each assembly including a number of coolant return pipes distributed among said fluid flow outlet means, said return pipes having open, radially outer ends in communication with said coolant chamber to receive return coolant;

each assembly including coolant feed chamber means communicating with said fluid flow outlet means;

each assembly including coolant discharge chamber means communicating with said return pipes;

axially spaced-apart seal means carried by said seal drum on opposite axial sides of said nozzles and said pipes to define the axial boundaries of said cooling chamber;

a liquid flow system including pumping means connected to supply liquid to said feed chamber means and said fluid flow outlet means at a temperature and with sufficient pressure that the velocity of the jets is sufficiently high that heat transfer at the caster drum rim is substantially by forced convection as distinguished from nucleate and film boiling.

2. The system of claim 1 wherein:

said liquid coolant is basically water.

3. The system of claim 1 wherein:

said liquid flow system includes separate feed pipe means and discharge pipe means for each coolant assembly; and control means associated with said pipe means to regulate the pressure in the cooling chamber associated with each coolant assembly substantially independently.

4. The system of claim 1 wherein:

the pressure in said feed chambers is in a range that the resultant said velocity of said jets is in a range of about 40 to 80 feet per second (12.2 to 24.4 m/s).

5. The system of claim 4 wherein:

the said velocity of said jets is about 60 feet per second (18.3 m/s) into at least the cooling chamber subtending the arc of the caster drum through which metal solidification takes place.

6. The system of claim 1 wherein:

each of said modular coolant assemblies spans an arc of about 90 degrees.

7. The system of claim 1 wherein:

each of said modular coolant assemblies is substantially the same in structure as the other coolant assemblies.

8. The system of claim 6 wherein:

said modular coolant assemblies total four so as to extend in end-to-end relation throughout a full circle.

9. The system of claim 1 wherein:

said fluid flow outlet means comprises a large number of relatively closely spaced, small diameter nozzles issuing a large number of discrete liquid coolant jets; and said return pipes comprise a lesser number and or larger internal diameter than said nozzles and distributed interstitially among said nozzles.

10. The system of claim 9 wherein:

the radially inner face of the peripheral rim of said caster drum is provided with axially spaced-apart rows of circumferential grooves corresponding to the number of axially spaced-apart rows of nozzles, and said nozzles project radially outwardly into said grooves.

11. The system of claim 9 wherein:

the ratio of the number of said jet nozzles to said return pipes is in the order of about 4 to 1.

12. The system of claim 1 wherein:

said seal means includes inflatably controlled, static seal means carried by said peripheral rim of said seal drum.

13. The system of claim 1 wherein:

said caster drum includes radially inwardly directed flange means depending from said peripheral rim at its axial end opposite said caster drum backplate; and dynamic seal means is provided between said caster drum flange and said seal drum, and between the backplates of said caster drum and seal drum.

14. A system according to claim 13 wherein:

said dynamic seal means are fluid pressure controlled.

* * * * *